US007690136B2

(12) United States Patent
Breken

(10) Patent No.: US 7,690,136 B2
(45) Date of Patent: Apr. 6, 2010

(54) TOOTH SYSTEM

(75) Inventor: Roelof Breken, Gorinchem (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 12/131,254

(22) Filed: Jun. 2, 2008

(65) Prior Publication Data

US 2009/0000159 A1 Jan. 1, 2009

(30) Foreign Application Priority Data

Jun. 1, 2007 (EP) ..... 07109464

(51) Int. Cl.
*E02F 9/28* (2006.01)

(52) U.S. Cl. ..... 37/452

(58) Field of Classification Search ..... 37/452–457, 37/449, 450, 446; 403/350, 374.3, 374.4, 403/372, 379.1, 379.5, 379.3; 172/753, 772
See application file for complete search history.

(56) References Cited

U.S. PATENT DOCUMENTS 2,385,395 A * 9/1945 Baer ..... 37/458
3,919,792 A * 11/1975 Hahn et al. ..... 37/455
4,642,920 A * 2/1987 Lehnhoff ..... 37/452
5,653,048 A * 8/1997 Jones et al. ..... 37/452
6,209,238 B1 * 4/2001 Ruvang ..... 37/455
6,240,663 B1 * 6/2001 Robinson ..... 37/458
6,729,052 B2 * 5/2004 Ollinger et al. ..... 37/452

* cited by examiner

*Primary Examiner*—Robert E Pezzuto
(74) *Attorney, Agent, or Firm*—Young & Thompson

(57) ABSTRACT

A tooth system for use in an earthmoving device, includes a tooth and an adapter onto which the tooth is mounted in a detachable fashion, the tooth including a longitudinally extending tooth web, a longitudinally extending tooth base and a longitudinally extending tooth head at a distance from the tooth base, the tooth base and tooth head also extending transversely with respect to the web. The adapter includes an adapter base intended to be fixed onto an earthmoving device, such as onto the teeth bars of a draghead, and an adapter head, a longitudinally extending undercut cavity being defined between the adapter base and the adapter head, wherein the tooth base is slidably fitted within the undercut cavity and wherein the adapter head is slidably fitted between the tooth base and the tooth head for mounting or dismounting the tooth with respect; to the front end of the adapter.

27 Claims, 9 Drawing Sheets

TOOTH SYSTEM

BACKGROUND OF THE INVENTION

The invention is related to a tooth system for use in an earthmoving device, such as a dredging or mining device, comprising a tooth and an adapter onto which the tooth is mounted in a detachable fashion, said tooth comprising a longitudinally extending tooth web, a longitudinally extending tooth base and a longitudinally extending tooth head at a distance from the tooth base, said tooth base and tooth head also extending transversely with respect to the web, said adapter comprising an adapter base which is to be fixed onto an earthmoving device, such as onto the teeth bars of a draghead, and an adapter head, a longitudinally extending undercut cavity being defined between the adapter base and the adapter head, wherein the tooth base is slidably fitted within the undercut cavity and wherein the adapter head is slidably fitted between the tooth base and the tooth head for mounting or dismounting the tooth with respect to the front end of the adapter, said adapter comprising at least one zone which faces a correspondingly shaped zone of the tooth.

DESCRIPTION OF THE RELATED ART

Such a tooth system is known from WO2005/005737. Said prior art tooth system is aimed at providing a reliable connection between the tooth and the adapter. Furthermore, the system should allow for a quick replacement of the tooth. The system can for instance be used in connection with dredging operations, in which case a number of adapters, each carrying a tooth, is mounted on the drag head of a dredger. In service, while carrying out dredging operations, both the teeth and the adapters are exposed to the influences of the materials which are being cut, such as rock, stones, sand and the like. These materials exert considerable forces on the teeth and also on the adapter, leading to wear of the tooth excavating part of the teeth, which therefore have to be replaced from time to time. However, it appears that the adapters also may suffer from considerable wear. This poses a problem in that said adapters in some cases are fixedly connected to e.g. the teeth bars of a draghead, such as by welding. In other cases, the adapters are fixed releasably.

The replacement of adapters is therefore much more cumbersome than the replacement of the teeth, which indeed have expressly been carried out for easy replacement. Worn out adapters however have the disadvantage that their function of firmly holding the teeth in place, is adversely influenced. The teeth in question will no longer be supported in an adequate way, which leads to a certain play of the tooth with respect to its adapter. These phenomena of play however further impair the proper functioning of the cutter head. Thus, after some time such a worn out adapter should be replaced as well, which means removing the welded connection, and welding replacement adapters onto the draghead.

SUMMARY OF THE INVENTION

The object of the invention is therefore to provide a tooth system of the type described before, which provides for a better support of the tooth with respect to its adapter, as well as for a better protection of the adapter against wear. This object is achieved in that at least one pair of correspondingly shaped facing zones of the adapter and the tooth comprises a stepped configuration.

The advantages of the stepped configuration of the facing zones of the adapter and the tooth according to the invention are twofold. First of all, such stepped layout of the facing zones represents a stable support for the tooth with respect to the adapter. The stepped zones represent separate areas for supporting the tooth, suitable for withstanding forces and bending moments exerted on the tooth. Moreover, such separate areas offer the possibility to accommodate any imperfections in the facing surfaces without impairing the stability of the tooth, which imperfections may result from the manufacturing process of the components in question.

Furthermore, the stepped configuration enables an easy replacement of the tooth with respect to the adapter. In this connection, preferably the stepped configuration may define a wide cavity section and a narrow cavity section of the adapter, whereby the wide cavity section borders the front end of the adapter. Alternatively or additionally, the stepped configuration may define a thin adapter flange section and a thick adapter flange section, whereby the thin adapter flange section borders the front end of the adapter. In particular, such stepped configuration comprises several lands and recesses of the pair of facing zones, whereby each time a pair of a land of the one component, and a recess of the other component are facing each other. Preferably, the adapter has at least an adapter recess bordering the front and thereof and at least an adapter land at the end of the adapter recess opposite the front and, in which case the tooth has at least a tooth land opposite the adapter recess and at least a tooth recess opposite the adapter land.

The recesses may have a larger longitudinal dimension than the corresponding lands. In such a layout, the facing recesses will overlap each other over a certain extent, thus providing a gap in the area of the overlap. Such layout provides advantages as to the accommodation of imperfections as addressed before.

In the prior art tooth system, the adapter head comprises opposite adapter flanges which enclose a slit at their facing edges and which delimit the undercut cavity, the web extending through the slit. In such an embodiment, the tooth head faces the adapter flanges. Furthermore, the tooth web is positioned in a slit defined between the opposite adapter flanges, the tooth base comprising tooth base flanges extending on opposite sides of the tooth web, each tooth base flange being positioned opposite a corresponding adapter flange. A firm additional support of the tooth with respect to the adapter is now obtained by these pairs of mutually cooperating pairs of a tooth head flange, an adapter flange and a tooth head flange.

Preferably, the pairs of a tooth base flange and a facing adapter flange each have facing flange surfaces which are oriented at equal but opposite angles. In this connection, the slanting tooth base flange surfaces each comprise a tooth base flange recess, which tooth flange recess faces a corresponding adapter flange inner land. Furthermore, the slanting tooth base surfaces each comprise a tooth base flange land which faces a corresponding adapter flange inner recess.

Preferably, the tooth head comprises two opposite tooth head flanges which are on opposite sides of the web. The tooth head flanges each comprise a tooth head flange land which faces a corresponding adapter flange outer recess. Additionally, the tooth head flanges each comprise a tooth head flange recess which faces a corresponding adapter flange outer land.

In a known way, the tooth comprises a front cover which is known per se. In the tooth system according to the invention, said front cover extends transversely with respect to the tooth web and faces the front end of the adapter. Preferably, the front cover of the tooth abuts the front end of the adapter so as to avoid clenching of the tooth with respect to the adapter which would prevent replacement of the tooth. In this connection, a further improvement of the tooth system according to the invention can be obtained in case the tooth head and the front cover are connected to each other, for instance at a sharp angle. The combined effect of the interconnected tooth head and front cover provides an advantageous shielding of the areas of the adapter which would otherwise be prone to the abrasive influences of the materials. Furthermore, the interconnected tooth head and front cover provide an additional stabilizing effect with respect to the correspondingly shaped adapter, the front of which is snugly surrounded by said combined tooth head and front cover.

Locking means may be provided which comprise a locking member positioned at an end of the undercut cavity of the adapter, and a locking part at the tooth base end facing the locking member. The locking member and the front cover are at opposite ends of the adapter.

For further improving the support of the tooth with respect to the adapter, the undercut cavity of the adapter may be tapered from a relatively wide front end to a relatively narrow back end, the tooth base having a corresponding taper. The front cover is at the relatively wide front end of the adapter and the locking element is at or near the relatively narrow back end of the adapter.

The tooth head covers the outwardly facing surfaces of the adapter to a large extent, which means that the adapter is largely shielded from the abrasive influences of the materials which are being cut loose. The tooth head itself will of course still be subjected to these wear phenomena, however having regard to the fact that the tooth, of which the to said forms part, is to be replaced from time to time anyway, such wear is quite acceptable.

BRIEF DESCRIPTION OF THE DRAWINGS

The invention will now be described further with reference to an embodiment shown in the figures.

DESCRIPTION OF THE PREFERRED EMBODIMENT

Figure 1:
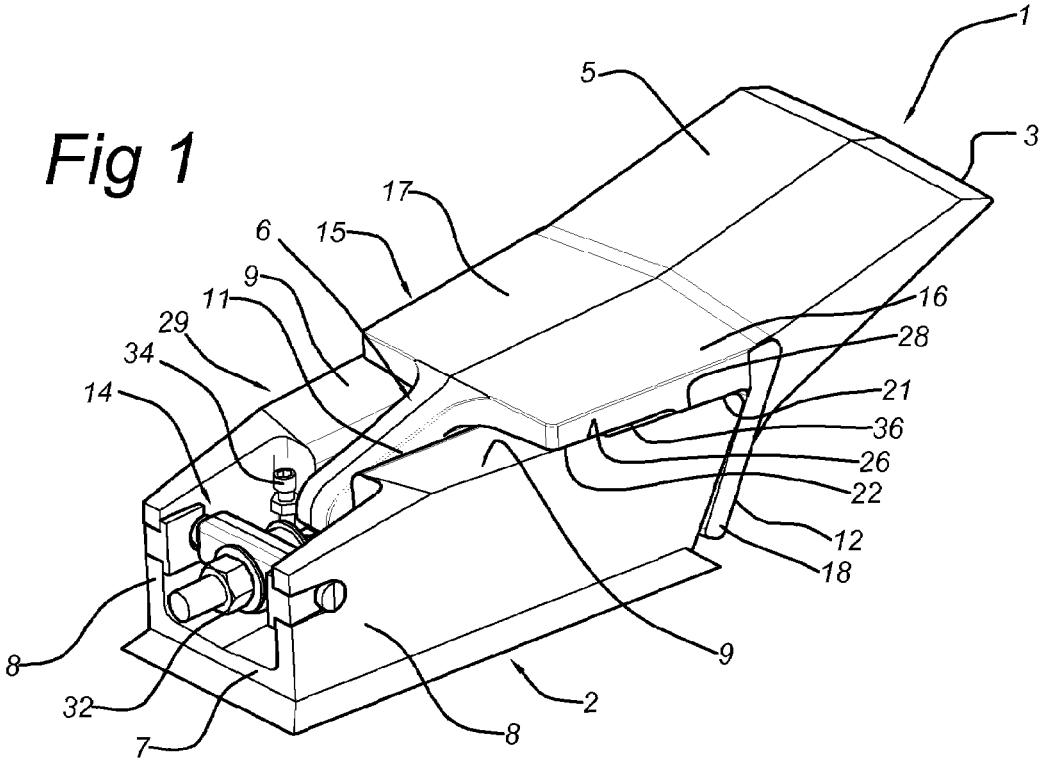
FIG. 1 shows a rear view in perspective of the tooth system according to the invention.
Figure 2:
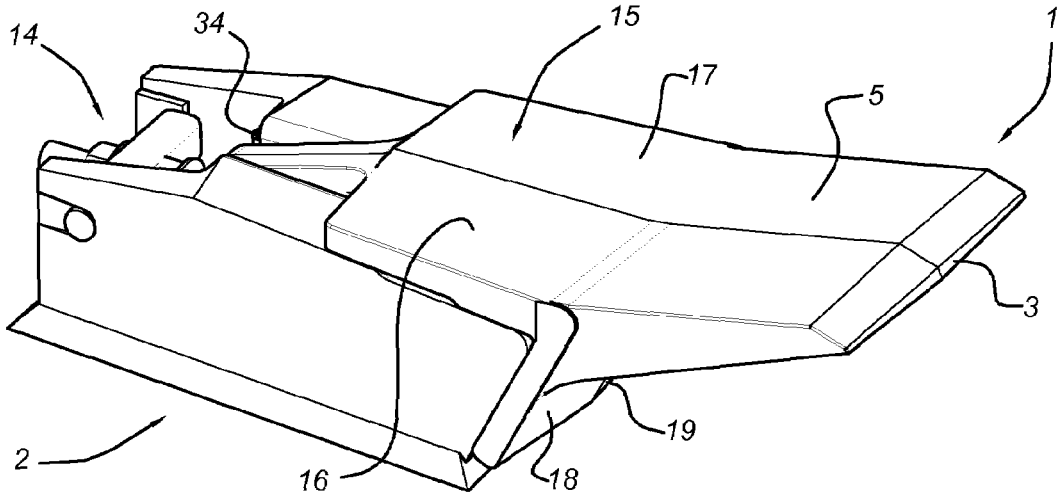
FIG. 2 shows a front view in perspective of the tooth system according to the invention.
Figure 3:
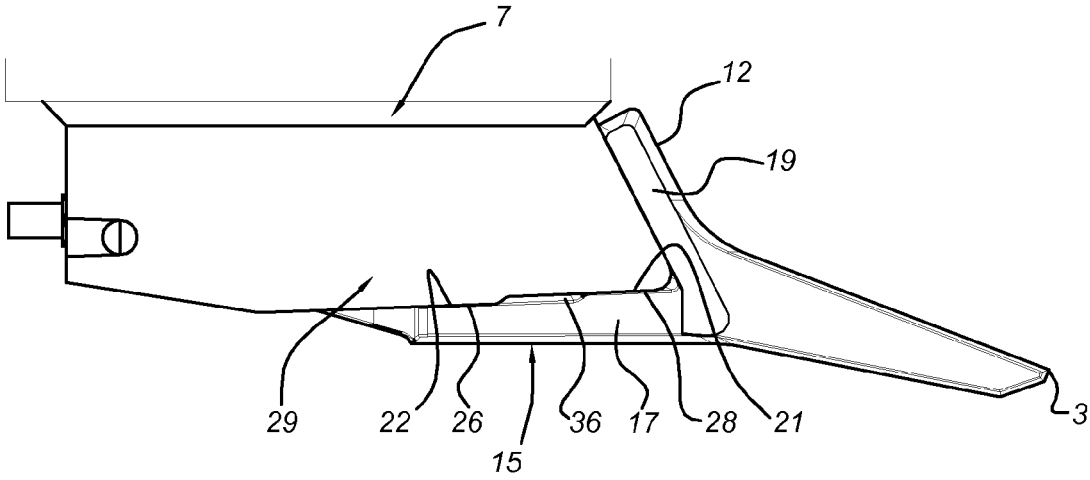
FIG. 3 shows a side view of the tooth system.
Figure 4:
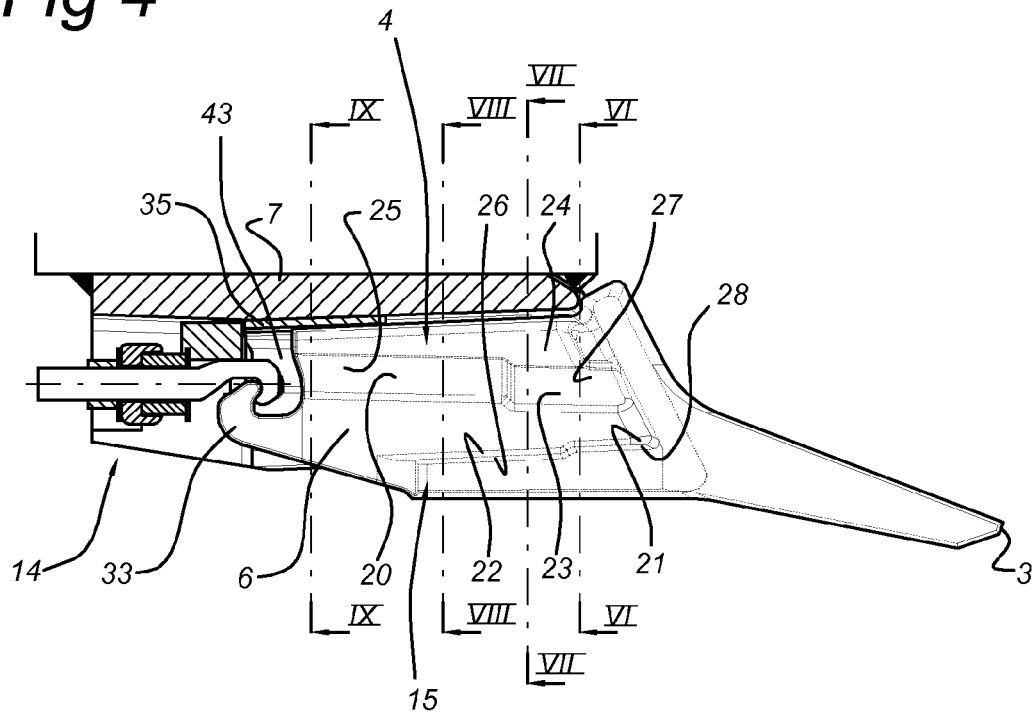
FIG. 4 shows a side view according to IV-IV of FIG. 5.
Figure 5:
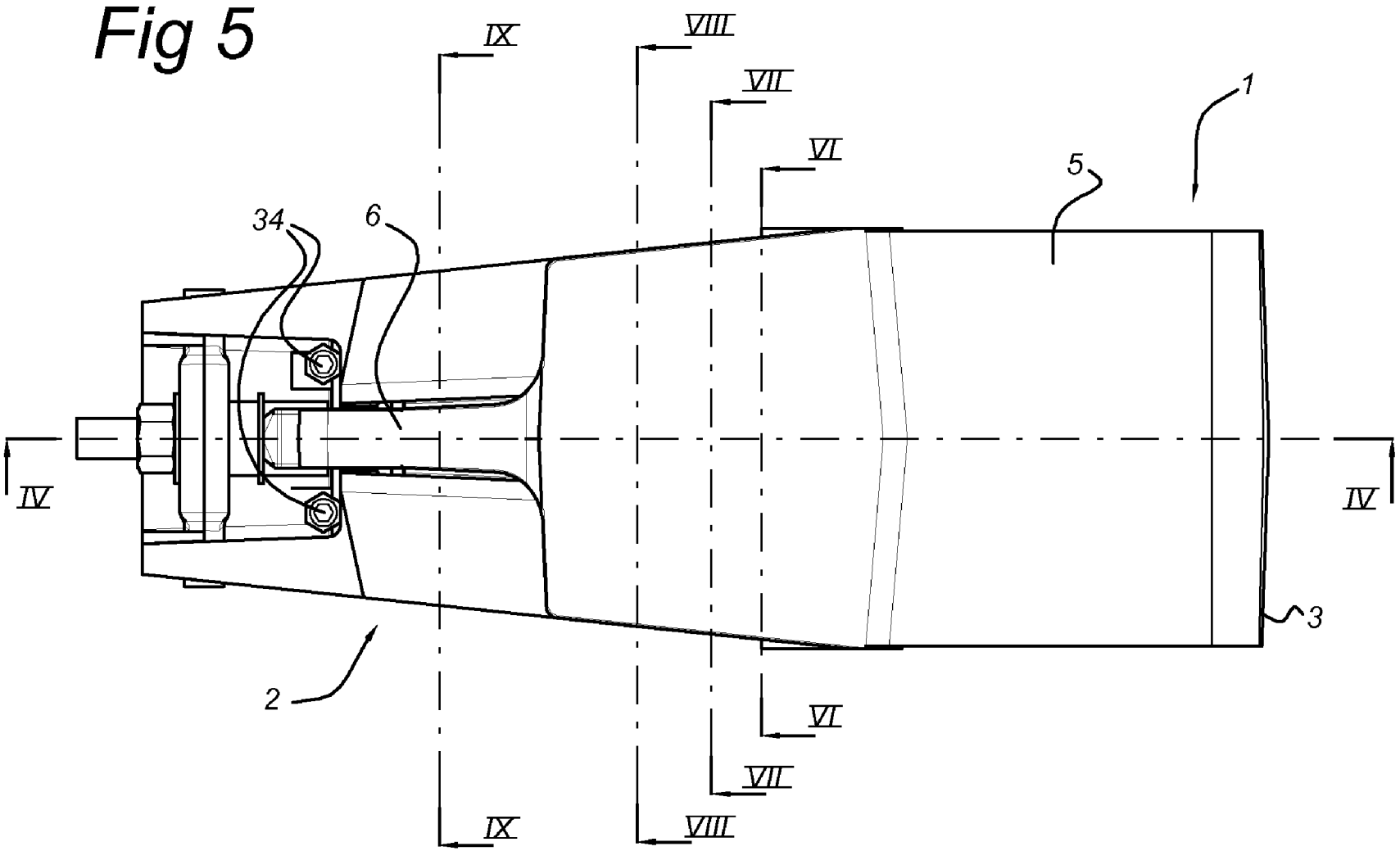
FIG. 5 shows a top view of the tooth system.
Figure 10:
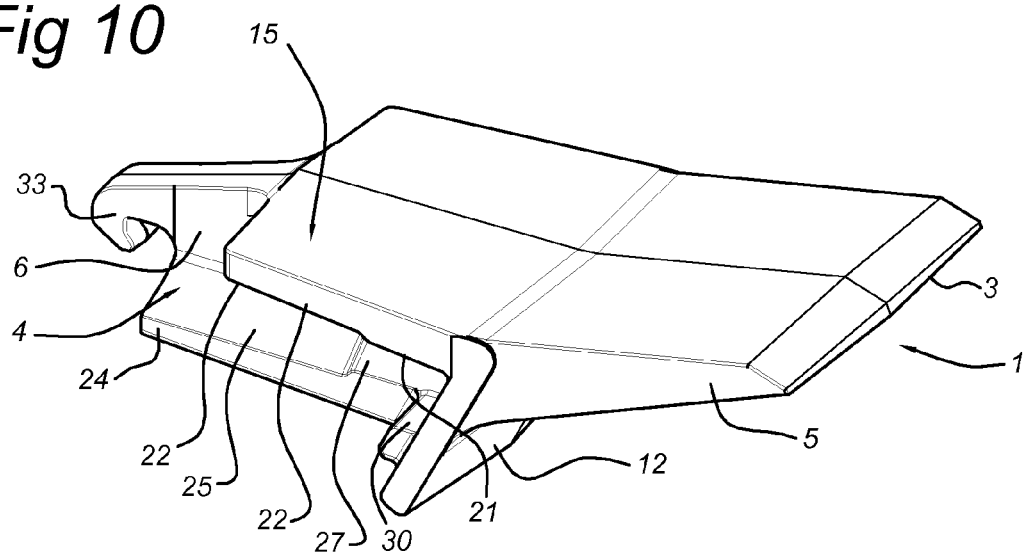
FIG. 10 shows a front view in perspective of the tooth.
Figure 11:
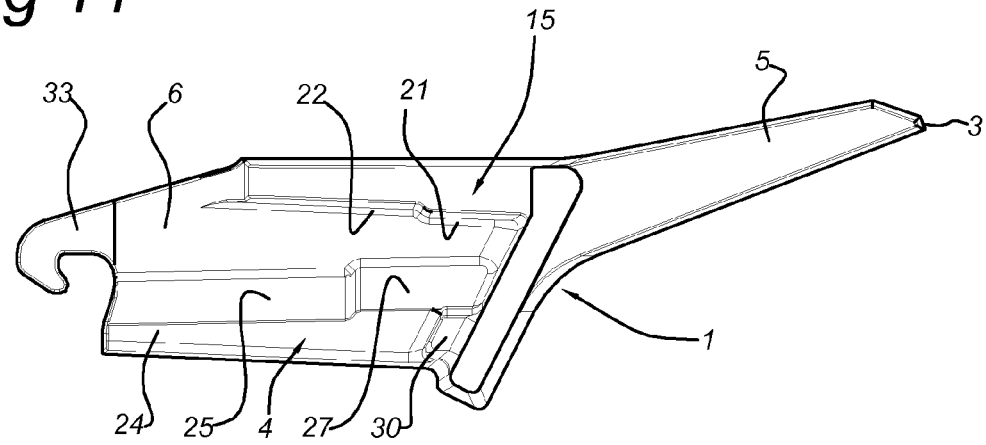
FIG. 11 shows a side view of the tooth.
Figure 12:
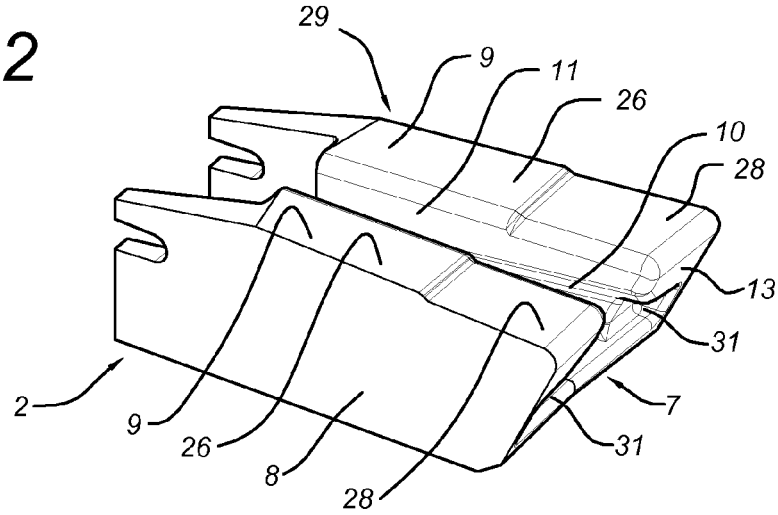
FIG. 12 shows a front view in perspective of the adapter.

The tooth system according to the invention, as shown in the figures, comprises a tooth 1 connected to the adapter 2. Said tooth 1 comprises a tooth base 4, as shown in FIGS. 4, 10 and 11, as well as a tooth excavating element 5 with a cutting edge 3. Furthermore, the tooth comprises a tooth web 6 which extends between the base 4 and the tooth head 15. Said tooth head 15 is located opposite the tooth base 4. The adapter 2 comprises an adapter base 7 having two opposite upstanding walls 8 which support the adapter head 29. The adapter head 29 is provided with facing adapter flanges 9. Said adapter base 7, upstanding walls 8 and adapter head 29 with adapter flanges 9 define an undercut cavity 10 which by means of slit 11 opens out at the position of the adapter flanges 9.

As shown in FIGS. 1-5, the tooth base 4 of the tooth 1 has been slid into the undercut cavity 10 of the adapter 2. At the same time, the tooth web 6 of the tooth 1 has been accommodated in the slit 11 of the adapter 2. As the tooth 1 comprises a front cover 12, opposite the front end 13 of the adapter 2, said sliding motion of the tooth 1 with respect to the adapter 2 is limited as soon as the front end 13 and the front cover 12, come into contact. With the aim of further improving the locking of the tooth 1 with respect to the adapter 2, the front end 13 of the adapter 2 comprises indentations 31, and the facing surface of the front cover 12 comprises protrusions 30 which are accommodated within said indentations 31. At the end of the adapter 2 opposite the front end 13, locking means 14 are provided for locking the tooth 1 with respect to the adapter 2. Said locking means 14 comprises a locking element 32 connected to the adapter 2, as well as a hook 33 forming part of the tooth 1 (see FIG. 4).

As mentioned before, the tooth 1 has been provided with a tooth head 15. Said tooth head 15 is connected to the front cover 12, and comprises two tooth head flanges 16, 17 on opposite sides of the web 6. Similarly, the front cover 12 comprises two flanges 18, 19, also on opposite sides of the web 6. The tooth head flanges 16, 17 each bear on a corresponding adapter flange 9. Said tooth head 15, in combination with the front cover 12, protects the adapter 2 with respect to the abrasive action of the materials which are being cut by the tooth system in question.

Figure 6:
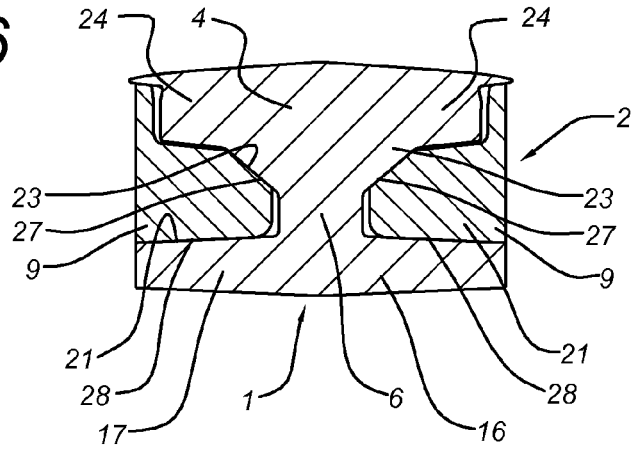
FIG. 6 shows a cross-section according to VI-VI of FIG. 5.
Figure 7:
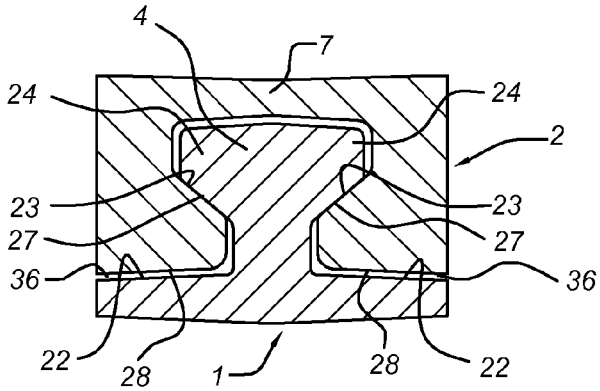
FIG. 7 shows a cross section according to VII-VII of FIG. 5.
Figure 8:
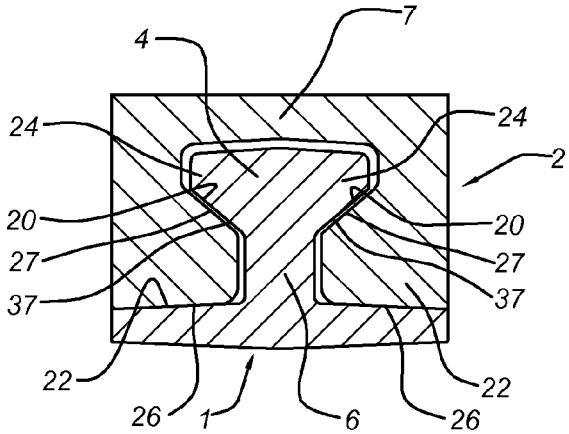
FIG. 8 shows a cross-section according to VIII-VIII of FIG. 5.

With the aim of improving a stable support of the tooth 1 with respect to the adapter 2, the tooth head flanges 16, 17 each comprise a tooth head flange recess 22 at their rearward end, as well as a tooth head flange land 21 at their forward end adjoining the front cover 12. Similarly, the adapter flanges 9 comprise adapter flange outer lands 26 at their rearward end, as well as adapter flange outer recesses 28 at their forward end. As a result, the tooth head flanges 16, 17 are stably supported with respect to the corresponding adapter flanges 9 through these pairs of tooth head flange lands 21 and adapter flange outer recesses 28 (see also the cross section of FIG. 6), as well as through the pairs of tooth head flange recesses 22 and adapter flange outer lands 26. (see also the cross-section of FIG. 8).

Figure 9:
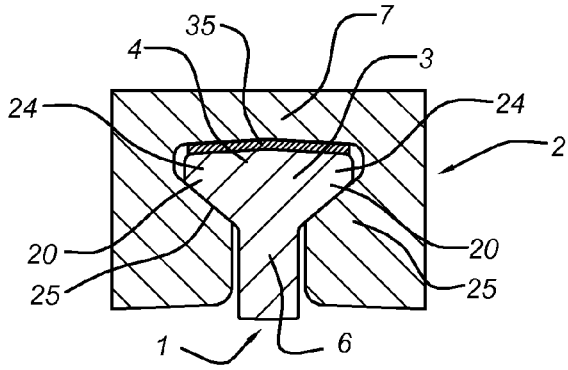
FIG. 9 shows a cross-section according to IX-IX of FIG. 5.

The tooth base 4 comprises tooth base flanges 24 at opposite ends of the web 6. These tooth base flanges 24 bear against the inner side of the adapter flanges 9. To that end, the adapter flanges 9 comprise an adapter flange inner recess 23 (see also the cross-section of FIG. 8) and an adapter flange inner land 20 (see also the cross-section of FIG. 9). Furthermore, the tooth base flanges 24 comprise a tooth base flange land 27 and a tooth base flange recess 25. By means of the pairs of an adapter flange inner land 20 and a tooth based flange recess 25, and the pairs of an adapter flange inner recess 23 and a tooth base flange land 27, the stable support of the tooth 1 with respect to the adapter flanges 9 of the adapter 2 is further improved.

The above pairs of lands and recesses are at a distance from each other, separated by gaps 36 and 37 as shown in FIG. 4. Thereby, any irregularities in the facing surfaces can be accommodated without however impairing the support stability.

Figure 13:
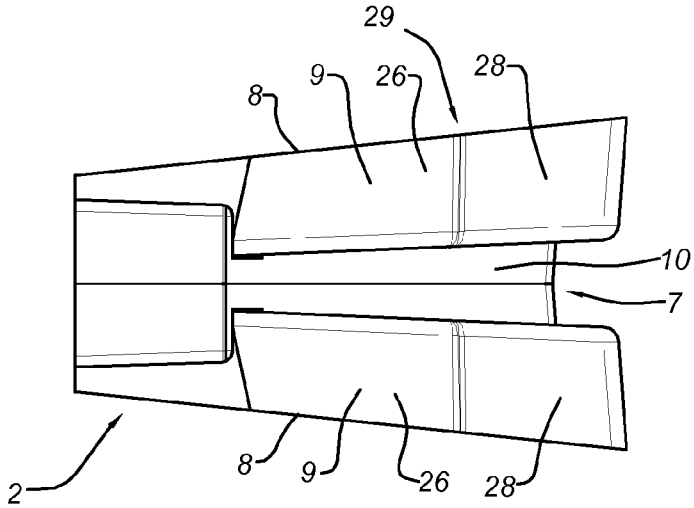
FIG. 13 shows a top view of the adapter.
Figure 14:
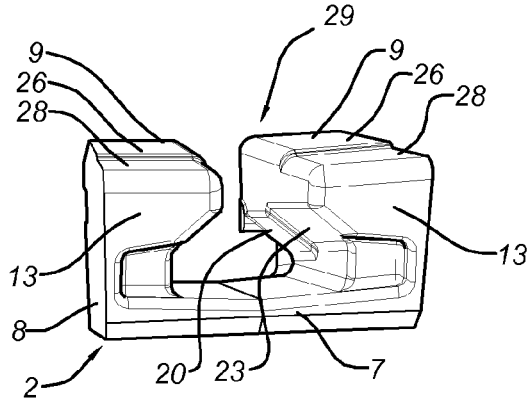
FIG. 14 shows a further front view in perspective of the adapter.
Figure 15:
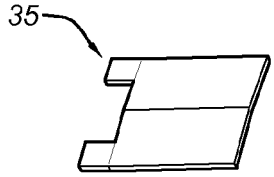
FIG. 15 shows a view in perspective of a wear plate.
Figure 16:
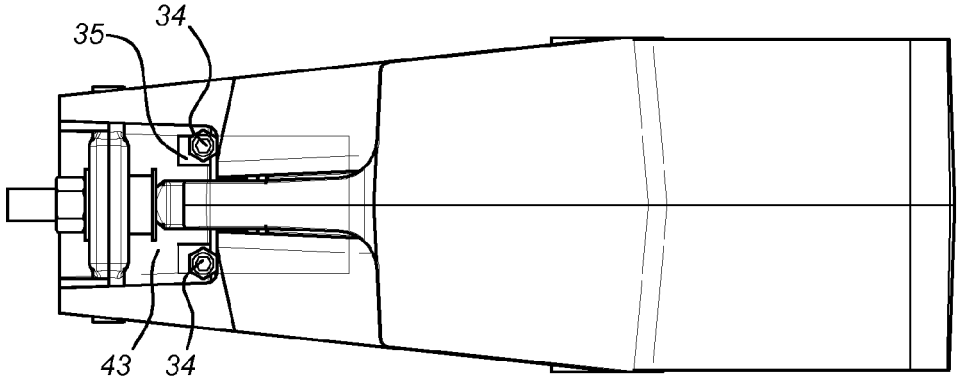
FIG. 16 shows a top view with the system provided with the wear plate according to FIG. 15.
Figure 17:
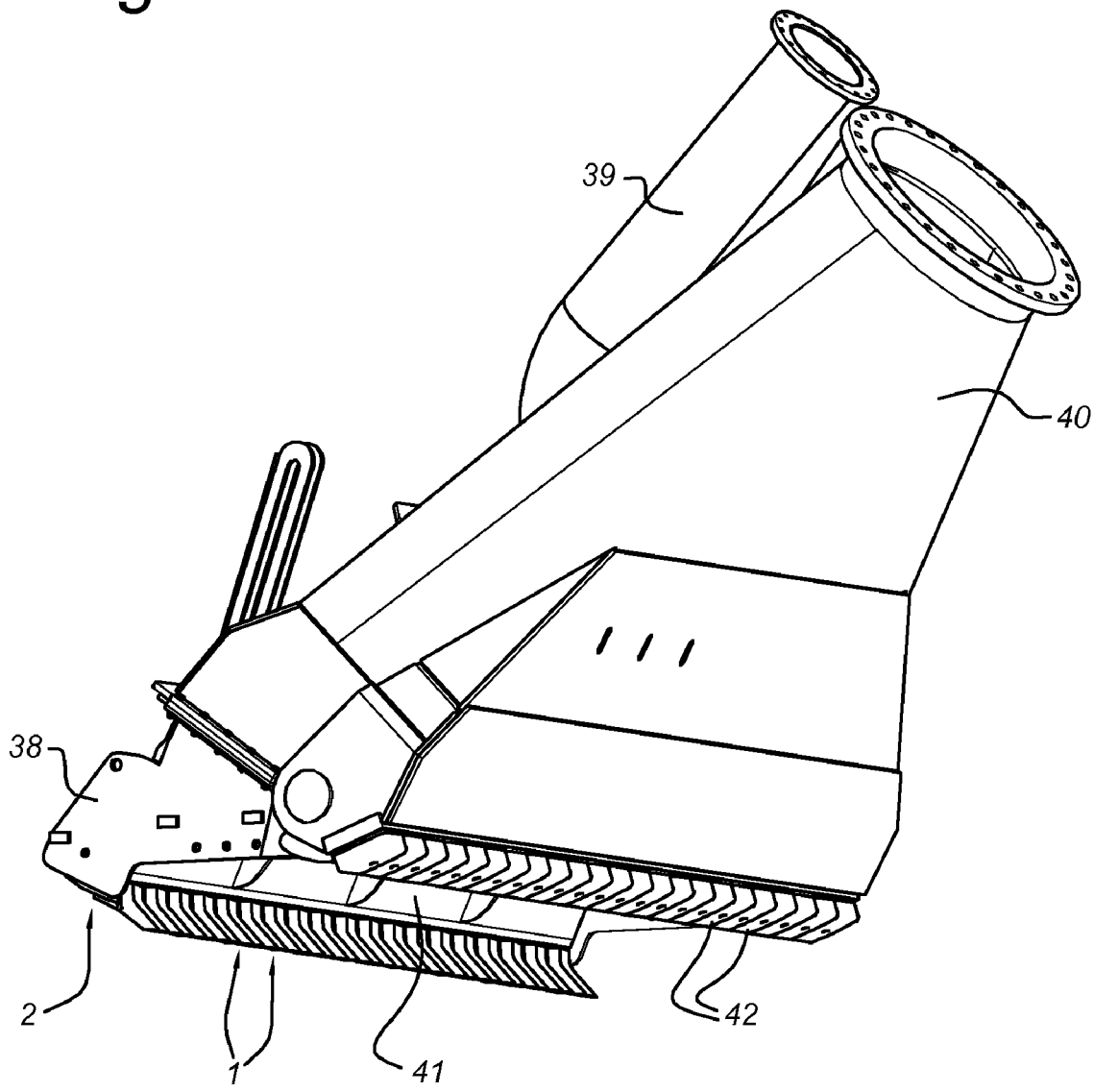
FIG. 17 shows a view in perspective from below on a suction cutter head provided with the tooth system according to the invention.

As will be clear from the top view of FIG. 13 and the sectional view of FIG. 4, the internal cavity 10 of the adapter 2 has a tapering shape, running from a relatively wide cross-section at the front end 13 towards the back end. Similarly, the tooth base 4 has a tapering shape so as to snugly fit within said internal cavity 10.

A wear plate 35 is positioned on the adapter base 7, as shown in FIGS. 4, 9, 15 and 16, and mounted by means of bolts 34. This wear plate protects the adapter base from wear, and can be easily replaced in case said plate has been worn down by multiple replacements of the tooth.

Figure 18:
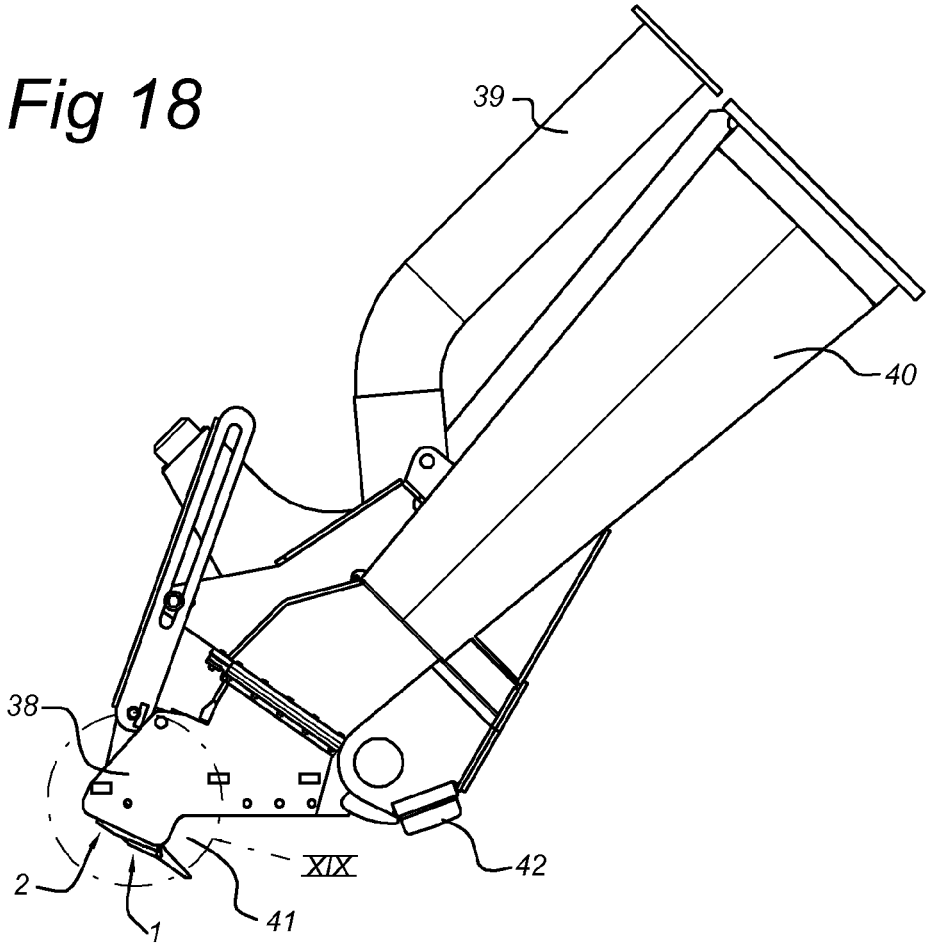
FIG. 18 shows a side view of the suction draghead according to FIG. 17.
Figure 19:
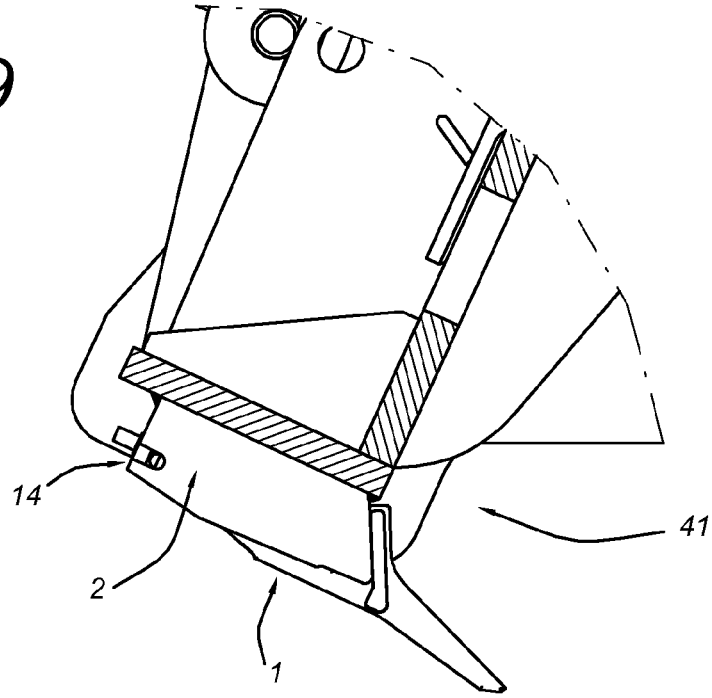
FIG. 19 shows the enlarged detail according to XIX of FIG. 18.
Figure 20:
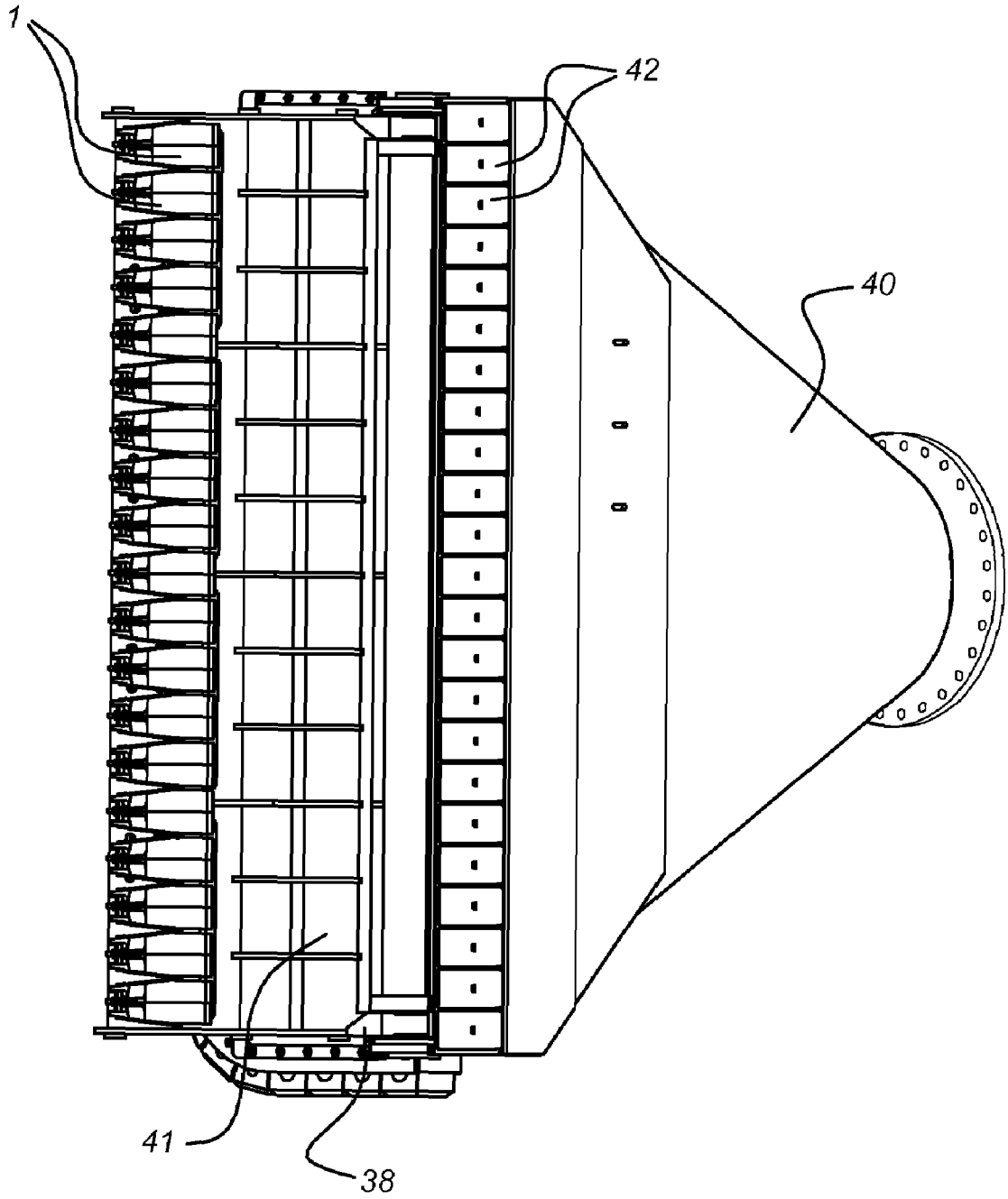
FIG. 20 shows a bottom view of the suction draghead according to FIG. 17.

The FIGS. 18-20 show an example of the application of the tooth system according to the invention in a suction cutter head. Generally the cutter head comprises a suction chamber housing 38 having a suction opening 41 and connected to the suction mouth 40 which is to be connected to a suction tube leading to the bin of a dredging vessel (not shown). Furthermore, a pressure conduit 39 is provided for supplying the jet nozzles with pressurized water used in the cutting process. The adapters 1 of the tooth system according to the invention are mounted on the suction chamber housing near the suction opening 41, whereby the teeth 2 are positioned in such a way that they can exert a cutting action on the bottom of a body of water while the suction cutter head is dragged (to the right in the figures) over said bottom.

LIST OF REFERENCES

1 tooth
2 adapter
3 tooth cutting edge
4 tooth base
5 tooth excavating element
6 tooth web
7 adapter base
8 upstanding adapter wall
9 adapter flange
10 undercut cavity
11 adapter slit
12 tooth front cover
13 adapter front end
14 locking means
15 tooth head
16 tooth head flange
17 tooth head flange
18 tooth front cover flange
19 tooth front cover flange
20 adapter flange inner land
21 tooth head flange land
22 tooth head flange recess
23 adapter flange inner recess
24 tooth base flange
25 tooth base flange recess
26 adapter flange outer land
27 tooth base flange land
28 adapter flange outer recess
29 adapter head
30 protrusion
31 indentation
32 locking member
33 locking part
34 bolt
35 wear plate
36 gap at tooth head
37 gap at tooth base
38 suction chamber housing
39 pressure conduit
40 suction mouth
41 suction opening
42 jet nozzles

The invention claimed is:

1. Tooth system for use in an earthmoving device, comprising:

a tooth (1); and an adapter (2), the tooth (1) mounted in a detachable fashion on the adapter (2), said adapter (2) comprising at least one zone which faces a correspondingly shaped zone of the tooth (1), said tooth (1) comprising i) a longitudinally extending tooth web (6), ii) a longitudinally extending tooth base (4), and iii) a longitudinally extending tooth head (15) at a distance from the tooth base (4), said tooth base and tooth head (15) also extending transversely with respect to the web (6), said adapter (2) comprising i) an adapter base (7) for fixing onto an earthmoving device, and ii) an adapter head (29), a longitudinally extending undercut cavity (10) being defined between the adapter base (7) and the adapter head (29), wherein, the tooth base (4) is slidably fitted within the undercut cavity (10), the adapter head (29) is slidably fitted between the tooth base (4) and the tooth head (15) for mounting or dismounting the tooth (1) with respect to a front end (13) of the adapter (2), wherein, at least one pair of correspondingly shaped facing zones of the adapter (2) and the tooth (1) comprises a stepped configuration, the adapter head (29) comprises opposite lateral adapter flanges (9), the opposite lateral adapter flanges delimit the undercut cavity (10), the opposite lateral adapter flanges (9) have facing edges enclosing a slit (11), the web (6) extends through the slit (11), and the tooth head (15) faces the adapter flanges (9).

2. Tooth system according to claim 1, wherein the stepped configuration defines a wide cavity section and a narrow cavity section, said wide cavity section bordering the front end (13) of the adapter (2).

3. Tooth system according to claim 1, wherein the stepped configuration defines a thin adapter flange section and a thick adapter flange section, and the thin adapter flange section borders the front end of the adapter (2).

4. Tooth system according to, claim 1 wherein the stepped configuration of the pair of facing zones comprises lands (20, 26; 27, 21) and recesses (25, 22; 23, 28).

5. Tooth system according to claim 4, wherein the recesses (25, 22; 23, 28) have a larger longitudinal dimension than the lands (20, 26; 27, 21), resulting in a gap (36, 37) in the area of facing recesses.

6. Tooth system according to, claim 1 wherein the adapter (2) has at least an adapter recess (23, 28) bordering the front end (13) thereof and at least an adapter land (20, 26) at the end of the adapter recess (23, 28) opposite the front end (13), the tooth (1) having at least a tooth land (27, 21) opposite the adapter recess (23, 28) and at least a tooth recess (25, 22) opposite the adapter land (20, 26).

7. System according to claim 1, wherein the tooth base (4) comprises tooth base flanges (24) extending on opposite sides of the web (6), each tooth base flange (24) facing a corresponding adapter flange (9).

8. System according to claim 7, wherein pairs of the tooth base flanges (24) and a facing adapter flange (9) each have facing flange surfaces which are oriented at equal but opposite angles.

9. System according to claim 8, wherein the slanting tooth base flange surfaces each comprise a tooth base flange recess (25), said tooth base flange recess (25) facing a corresponding adapter flange inner land (20).

10. System according to claim 8, wherein the slanting tooth base surfaces each comprise a tooth base flange land (27), said tooth base flange land (27) facing a corresponding adapter flange inner recess (23).

11. System according to, claim 1 wherein the tooth head (15) comprises two opposite tooth head flanges (16, 17).

12. System according to claim 11, wherein the tooth head flanges (16, 17) are on opposite sides of the web (4).

13. System according to claim 11, wherein the tooth head flanges (16, 17) each comprise a tooth head flange land (21), said tooth head flange land (21) facing a corresponding adapter flange outer recess (28).

14. System according to claims 13, wherein the tooth head flanges (16, 17) each comprise a tooth head flange recess (22), said tooth head flange recess (22) facing a corresponding adapter flange outer land (26).

15. System according to, claim 1 wherein the tooth comprises a front cover (12) which extends transversely with respect to the tooth head (15) and which faces the front end (13) of the adapter (2).

16. System according to claim 15, wherein the tooth head (15) and the front cover (12) are connected to each other, for instance at a sharp angle.

17. System according to claim 15, wherein the front cover (12) has protrusions (30) and the frontside (13) of the adapter (2) comprises indentations (31) accomodating said protrusions (30).

18. System according to, claim 15 wherein the front cover (12) comprises front cover flanges (18, 19) extending on opposite sides of the web (4).

19. System according to claim 18, wherein the tooth head flanges (16, 17) each comprise a tooth head flange land (21), and each tooth head flange land (21) adjoins a corresponding front cover flange (18, 19).

20. System according to, claim 15 wherein locking means (14) are provided which comprise a locking member (32) positioned at an end of the undercut cavity (10) of the adapter (2), and a locking part (33) at the tooth web (6) facing the locking member (32).

21. System according to claim 20, wherein the locking member (14) and the front cover (12) are at opposite ends of the adapter (2).

22. System according to, claim 21 wherein the undercut cavity (10) of the adapter (2) is tapered from a relatively wide front end (13) to a relatively narrow back end, the base member (4) of the tooth (1) having a corresponding taper.

23. System according to claim 22, wherein the front cover (12) is at the relatively wide front end (13) of the adapter (2) and the locking element (32) is at or near the relatively narrow back end of the adapter (2).

24. System according to, claim 1 wherein the tooth (1) comprises a tooth excavating element (5) which extends from the tooth head (15).

25. System according to, claim 1 wherein a wear plate (35) is provided between the adapter base (7) and the tooth base (4).

26. System according to claim 1, wherein locking means (14) are provided which comprise a locking member (32) positioned at an end of the undercut cavity (10) of the adapter (2), and a locking part (33) at the tooth web (6) facing the locking member (32).

27. System according to claim 1, wherein the undercut cavity (10) of the adapter (2) is tapered from a relatively wide front end (13) to a relatively narrow back end, the base member (4) of the tooth (1) having a corresponding taper.

* * * * *